US011085201B2

(12) United States Patent
Sun et al.

(10) Patent No.: US 11,085,201 B2
(45) Date of Patent: Aug. 10, 2021

(54) BUTTON-TYPE CENTRAL LOCKING DEVICE FOR FOLDING TENT

(71) Applicant: ZHEJIANG YOTRIO GROUP CO., LTD, Zhejiang (CN)

(72) Inventors: Linyong Sun, Zhejiang (CN); Jianqiang Xie, Zhejiang (CN)

(73) Assignee: ZHEJIANG YOTRIO GROUP CO., LTD, Zhejiang (CN)

( * ) Notice: Subject to any disclaimer, the term of this patent is extended or adjusted under 35 U.S.C. 154(b) by 0 days.

(21) Appl. No.: 16/865,405

(22) Filed: May 3, 2020

(65) Prior Publication Data

US 2020/0347635 A1 Nov. 5, 2020

(30) Foreign Application Priority Data

May 5, 2019 (CN) ..... 201920629422.3

(51) Int. Cl.
*E04H 15/48* (2006.01)

(52) U.S. Cl.
CPC ..... *E04H 15/48* (2013.01)

(58) Field of Classification Search
CPC ..... E04H 15/48; E04H 15/50
See application file for complete search history.

(56) References Cited

U.S. PATENT DOCUMENTS

| | | | | |
|---|---|---|---|---|
| 2,771,087 | A * | 11/1956 | Simonson | E04H 15/28 135/126 |
| 5,499,646 | A * | 3/1996 | Lee | E04H 15/28 135/121 |
| 6,199,572 | B1 * | 3/2001 | Rousselle | E04H 15/28 135/128 |
| 7,350,532 | B2 * | 4/2008 | Wu | E04H 15/48 135/135 |
| 10,822,829 | B1 * | 11/2020 | Lu | E04H 15/48 |
| 2005/0097829 | A1 * | 5/2005 | Seo | E04H 15/50 52/79.1 |
| 2018/0209167 | A1 * | 7/2018 | Yang | E04H 15/48 |
| 2019/0234102 | A1 * | 8/2019 | Lu | E04H 15/46 |
| 2019/0368232 | A1 * | 12/2019 | Sun | E05B 65/00 |
| 2020/0181939 | A1 * | 6/2020 | Ying | E04H 15/28 |
| 2020/0240167 | A1 * | 7/2020 | Sun | E04H 15/32 |

FOREIGN PATENT DOCUMENTS

CN 202850585 4/2013

* cited by examiner

*Primary Examiner* — Noah Chandler Hawk
(74) *Attorney, Agent, or Firm* — JCIP Global Inc.

(57) ABSTRACT

A button-type central locking device is adapted for a folding tent and includes a top tray seat, a lower tray seat and a locking tube. The lower tray seat includes a lower tray seat body and a lower tray seat cover. A central hole for insertion of the locking tube is provided at corresponding central positions of the top tray seat, the lower tray seat body and the lower tray seat cover. A lock-up mechanism used in mutual cooperation is provided between a lower end of the locking tube and the lower tray seat body. When the button is pressed, the tent can be retracted and closed, and when the button is released, the tent can be unfolded and fixed.

8 Claims, 5 Drawing Sheets

BUTTON-TYPE CENTRAL LOCKING DEVICE FOR FOLDING TENT

CROSS-REFERENCE TO RELATED APPLICATION

This application claims the priority benefit of China application serial no. 201920629422.3, filed on May 5, 2019. The entirety of the above-mentioned patent application is hereby incorporated by reference herein and made a part of this specification.

BACKGROUND

Technical Field

The invention pertains to the technical field of folding tents, and specifically relates to a button-type central locking device for a folding tent.

Description of Related Art

Folding tents are widely used because they are convenient to carry and have the function of blocking sunlight and rain. They are unfolded in use, and are retracted and folded when not in use. Therefore, the mechanism for opening and closing a folding tent is particularly important.

The structures of the existing mechanisms for opening and closing a folding tent are relatively complicated, and usually require multiple people to operate at the same time to complete the storage of the folding tent. For example, Chinese patent No. 201220456317.2 discloses a quick-folding tent and a slider locking mechanism, the quick-folding tent comprises a plurality of telescopic legs, eave crossing tubes, sliders and slider locking mechanism. The eave crossing tubes are connected to the sliders that are slidable along the telescopic legs. The slider locking mechanism includes a spring and a ball-shaped member, the spring and the ball are located in one of the telescopic leg and the slider, and the other of the telescopic leg and the slider is provided with a recess or hole that may be detachably fitted with the ball. The ball may be fitted with the recess or hole to lock the slider under the action of the spring, or may be disengaged from the recess or hole to enable the sliding of the slider along the telescopic leg. The above structure requires the completion of unlocking of four support legs to open, close or store the folding tent, the structure and operation of which are relatively cumbersome and complicated and are not convenient for a single person to operate.

SUMMARY

In view of the problems in the prior art, the purpose of the present invention design is to provide a button-type central locking device for a folding tent.

The invention is implemented through the following technical solutions.

A button-type central locking device is adapted for a folding tent, and includes a top tray seat for mounting a top framework rod of the folding tent, a lower tray seat for mounting a support rod of the folding tent, and a locking tube for connecting the top tray seat and the lower tray seat. The lower tray seat includes a lower tray seat body and a lower tray seat cover. A central hole for insertion of the locking tube is provided at corresponding central positions of the top tray seat, the lower tray seat body and the lower tray seat cover, and the locking tube is provided with an elastic locking member for lock-up cooperation with the lower tray seat.

The button-type central locking device further includes a lock-up mechanism that cooperates with the elastic locking member. The lock-up mechanism includes a round tube plug, a first positioning hole provided on a side wall of the round tube plug, and a second positioning hole provided at a lower end of the locking tube and used in cooperation with the first positioning hole. An upper end of the round tube plug is inserted and arranged inside the locking tube, the upper end of the round tube plug is open, and an accommodation cavity is provided therein. The elastic locking member is cooperatively mounted inside of the accommodation cavity.

The elastic locking member includes a locking pin and an elastic member. The locking pin is composed of a pin rod and a pin cap provided at one end of the pin rod. Both ends of the elastic member are in contact with an inner wall of the accommodation cavity and the pin cap, respectively, and the pin rod extends out of the first positioning hole and the second positioning hole and contacts a button.

The elastic locking member is a single-sided elastic protrusion structure, which includes an inverted V-shaped elastic member and an elastic protrusion provided at an open end of the inverted V-shaped elastic member. The elastic protrusion extends out of the first positioning hole and the second positioning hole and contacts a button, and the other end of the inverted V-shaped elastic member is arranged to abut a cavity wall of the accommodation cavity.

The elastic member is a straight spring or a V-shaped spring.

An end of the V-shaped spring in contact with the pin cap integrally extends to form a foot, and the foot and the V-shaped spring are arranged at an angle of 90 degrees.

The button-type central locking device further includes a button. Upper and lower sides of the button are correspondingly provided with bosses, the lower tray seat body and the lower tray seat cover are provided with grooves at positions corresponding to the bosses, and the bosses are respectively used in cooperation with the grooves.

Four connection posts are evenly provided on an upper surface of the lower tray seat cover, four connection holes are provided at positions of a lower surface, of the lower tray seat body, corresponding to the connection posts, and the connection posts are respectively inserted and arranged in the connection holes and fastened with screws.

Notches for mounting a button are respectively provided at corresponding positions of the lower tray seat body and the lower tray seat cover.

Through the cooperation of the elastic locking member and the button as provided, the invention has a simple structure and a low cost. When the button is pressed, the tent can be retracted and closed. When the button is released, the tent can be unfolded and fixed. The operation is convenient and fast, and is easy to be realized.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
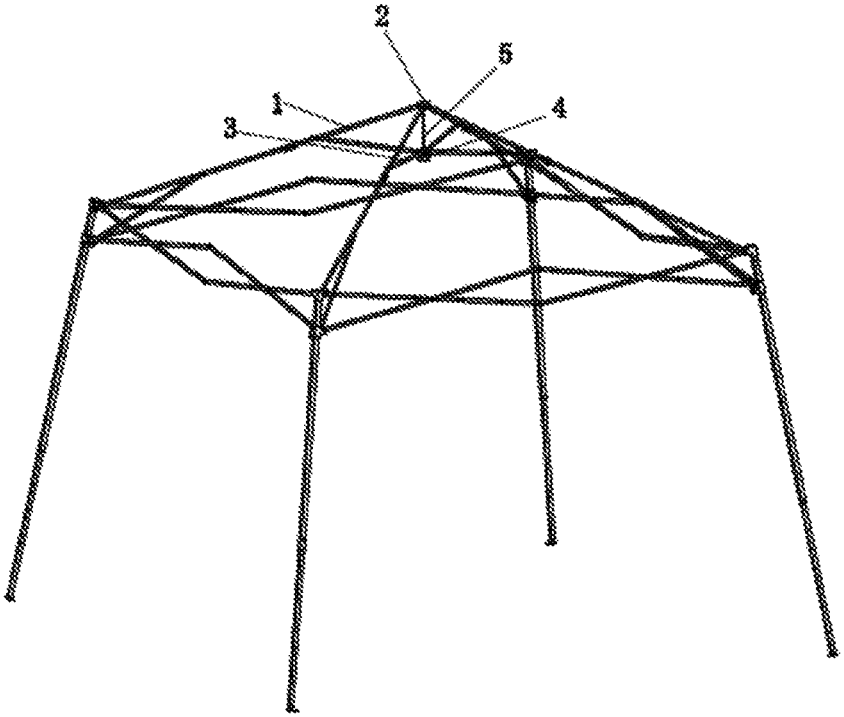
FIG. 1 is a schematic view of a structure of a button-type central locking device according to the invention mounted on a folding tent.

The invention will be described in further detail below with reference to the accompanying drawings of the specification, and specific embodiments are given.

As shown in FIG. 1 to FIG. 8, the invention provides a button-type central locking device adapted for a folding tent. The button-type central locking device is used mainly for unfolding, fixing, folding, retracting and closing of the folding tent. The structure of the central locking device mainly comprises a top tray seat 2 for mounting a top framework rod 1 of the folding tent, a lower tray seat 4 for mounting a support rod 3 of the folding tent, and a locking tube 5 for connecting the top tray seat 2 and the lower tray seat 4. The lower tray seat 4 includes a lower tray seat body 4-1 and a lower tray seat cover 4-2. A central hole 4-3 for insertion of the locking tube 5 is provided at corresponding central positions of the top tray seat 2, the lower tray seat body 4-1 and the lower tray seat cover 4-2. Four connection posts 4-5 are evenly provided on an upper surface of the lower tray seat cover 4-2, and four connection holes 4-6 are provided at the positions of a lower surface of the lower tray seat body 4-1 corresponding to the connection posts 4-5. The connection posts 4-5 are respectively inserted and arranged in the connection holes 4-6 and fastened with screws. As such, the lower tray seat body 4-1 and the lower tray seat cover 4-2 can be connected.

In order to unfold, fix, fold, retract and close the folding tent, a lock-up mechanism used in mutual cooperation is provided between a lower end of the locking tube 5 and the lower tray seat body 4-1. Specifically, the lock-up mechanism includes a round tube plug 6, a first positioning hole 6-1 provided on a side wall of the round tube plug 6, a second positioning hole 5-1 provided at the lower end of the locking tube 5 and used in cooperation with the first positioning hole 6-1, and a button 7 provided between the lower tray seat body 4-1 and the lower tray seat cover 4-2. Notches for mounting the button 7 are respectively provided at corresponding positions of the lower tray seat body 4-1 and the lower tray seat cover 4-2. Upper and lower sides of the button 7 are correspondingly provided with bosses 7-1, and the lower tray seat body 4-1 and the lower tray seat cover 4-2 are provided with grooves at positions corresponding to the bosses 7-1. The bosses 7-1 are used in cooperation with the grooves 4-4, that is, the bosses 7-1 are respectively engaged with the grooves 4-4. It is also possible that the boss is provided on a single side of the button. An upper end of the round tube plug 6 is inserted and arranged inside the locking tube 5. The upper end of the round tube plug 6 is open, and an accommodation cavity 6-2 is provided therein. An elastic locking member used in cooperation with the button 7 is provided in the accommodation cavity 6-2.

First Embodiment

Figure 2:
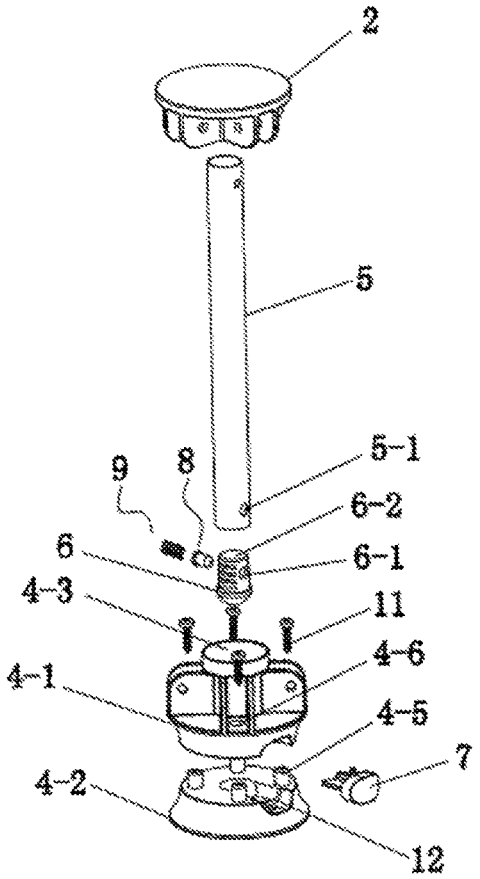
FIG. 2 is an exploded schematic structural view of a central locking device of a first embodiment.
Figure 3:
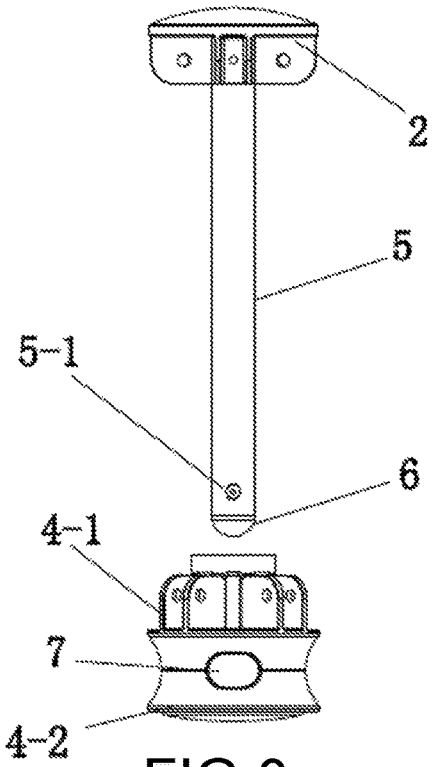
FIG. 3 is a partially assembled schematic structural view of the first embodiment.
Figure 4:
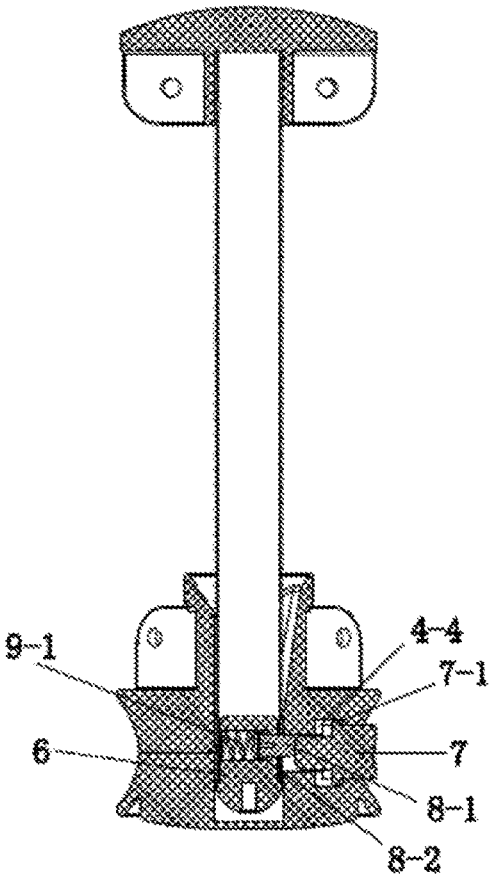
FIG. 4 is an assembled schematic cross-sectional structural view of the first embodiment.
Figure 5:
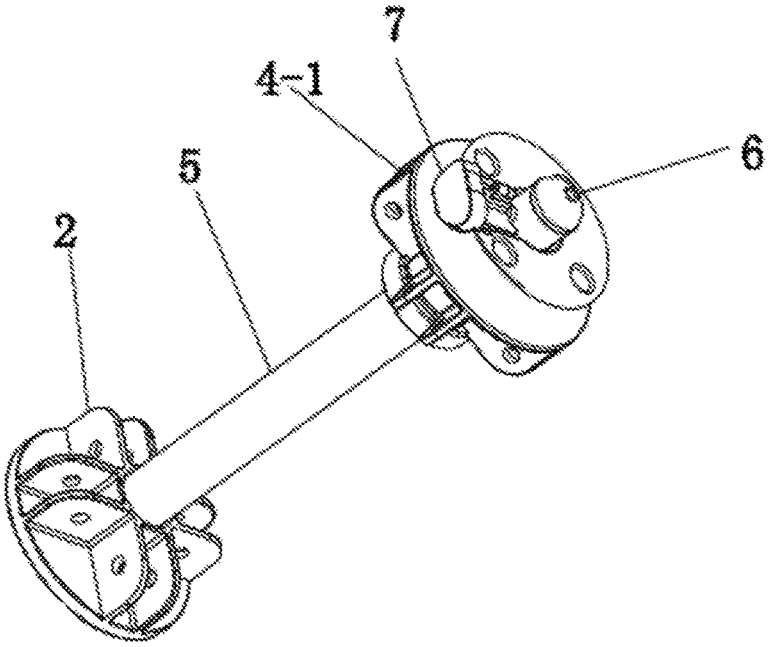
FIG. 5 is a schematic view of an assembled structure of a lower tray seat body and a button.
Figure 6:
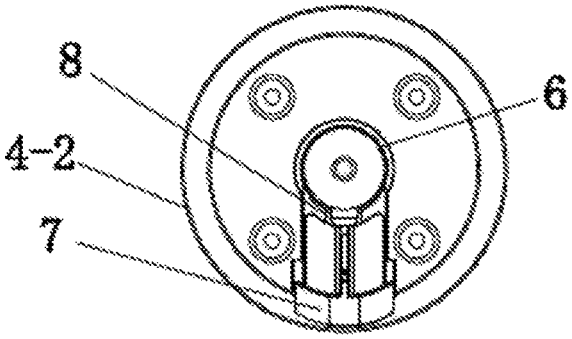
FIG. 6 is a top view of FIG. 5.

As shown in FIG. 2 and FIG. 4, the elastic locking member includes a locking pin 8 and an elastic member 9. The locking pin 8 is composed of a pin rod 8-1 and a pin cap 8-2 provided at one end of the pin rod 8-1. The elastic member 9 is a straight spring 9-1, and both ends of the straight spring are respectively in contact with an inner wall of the accommodation cavity 6-2 and the pin cap 8-2. The pin rod 8-1 extends out of the first positioning hole 6-1 and the second positioning hole 5-1 and contacts a button 7.

During the mounting process of this embodiment, the top tray seat 2 is fixed in cooperation with one end of the locking tube 5, the locking pin 8 and the straight spring 9-1 are placed into the accommodation cavity 6-2 through the open end of the round tube plug 6, and one end of the straight spring 9-1 is in close contact with the pin cap 8-2. The assembled locking pin 8, the elastic member 9 and the round tube plug 6 are placed together from the lower end of the locking tube 5 into the locking tube 5, and a portion of the round tube plug 6 is exposed outside the locking tube 5. After the pin rod 8-1 passes through the first positioning hole 6-1 and the second positioning hole 5-1 at a time, the pin rod 8-1 protrudes out of the locking tube 5 and is used in cooperation with the button 7.

In use, when the locking tube 5 is inserted into the lower tray seat body 4-1 from top to bottom, the locking pin 8 is inserted along an arc channel of the lower tray seat body 4-1. During the downward movement of the locking tube 5, the pin rod 8-1 of the locking pin 8 is squeezed, and the straight spring 9-1 cooperated therewith is compressed until the second positioning hole 5-1 on the locking tube 5 overlaps the first positioning hole 6-1 on the round tube plug 6. At this time, the straight spring 9-1 naturally stretches and pushes the locking pin 8 to stretch horizontally, causing the button 7 in contact with the locking pin 8 to move outward in a horizontal direction, and the locking pin 8 is in close contact with the button 7. A lock-up state is achieved under the action of the straight spring 9-1, thereby unfolding and fixing the tent. When the tent is to be retracted and closed, the button 7 requires to be pressed horizontally to overcome the resistance of the straight spring 9-1, making the locking pin 8 contacting thereof disengage from the button 7, and the locking tube 5 is separated from bottom to top, so as to realize folding, retracting and closing of the tent.

Second Embodiment

Figure 7:
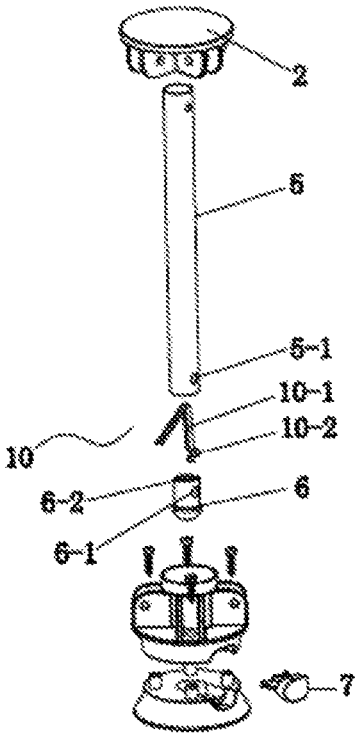
FIG. 7 is a schematic structural view of a second embodiment.

As shown in FIG. 7, the elastic locking member is a single-sided elastic protrusion structure 10, which includes an inverted V-shaped elastic member 10-1 and an elastic protrusion 10-2 provided at an open end of the inverted V-shaped elastic member 10-1. The elastic protrusion 10-2 extends out of the first positioning hole 6-1 and the second positioning hole 5-1 and contacts the button 7, and the other end of the inverted V-shaped elastic member 10-1 is arranged to abut a cavity wall of the accommodation cavity 6-2. The single-sided elastic protrusion structure 10 may also directly extend out of the positioning hole of the locking tube 5, and the tube plug 6 only serves as a guiding member.

The working principle and process of this embodiment are the same as those of the first embodiment.

Third Embodiment

Figure 8:
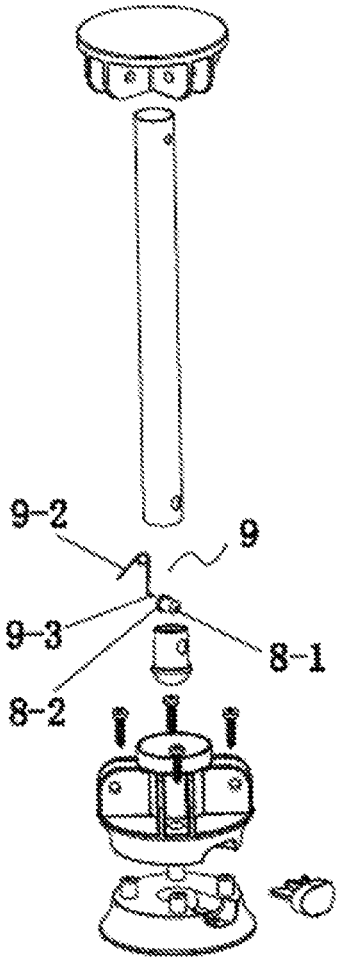
FIG. 8 is a schematic structural view of a third embodiment.

As shown in FIG. 8, the structures of this embodiment and the first embodiment are substantially the same. The difference is that the elastic member 9 is a V-shaped spring 9-2, an end of the V-shaped spring 9-2 in contact with the pin cap 8-2 integrally extends to form a foot 9-3, and the foot 9-3 and the V-shaped spring 9-2 is arranged at an angle of 90 degrees.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A button-type central locking device adapted for a folding tent, the button-type central locking device comprising a top tray seat for mounting a top framework rod of the folding tent, a lower tray seat for mounting a support rod of the folding tent, and a locking tube connecting the top tray seat and the lower tray seat, wherein the lower tray seat includes a lower tray seat body and a lower tray seat cover, a central hole for insertion of the locking tube is provided at corresponding central positions of the top tray seat, the lower tray seat body and the lower tray seat cover, and the locking tube is provided with an elastic locking member for lock-up cooperation with the lower tray seat, wherein the button-type central locking device further comprising a lock-up mechanism that cooperates with the elastic locking member, wherein the lock-up mechanism includes a round tube plug, a first positioning hole provided on a side wall of the round tube plug, and a second positioning hole provided at a lower end of the locking tube and in cooperation use with the first positioning hole, an upper end of the round tube plug is inserted inside the locking tube, the upper end of the round tube plug is open, and an accommodation cavity is provided therein, and the elastic locking member is cooperatively mounted inside of the accommodation cavity.

2. The button-type central locking device for the folding tent according to claim 1, wherein the elastic locking member includes a locking pin and an elastic member, the locking pin is composed of a pin rod and a pin cap provided at one end of the pin rod, both ends of the elastic member are respectively in contact with an inner wall of the accommodation cavity and the pin cap, and the pin rod extends out of the first positioning hole and the second positioning hole and contacts a button.

3. The button-type central locking device for the folding tent according to claim 2, wherein the elastic member is a straight spring or a V-shaped spring.

4. The button-type central locking device for the folding tent according to claim 1, wherein the elastic locking member is a single-sided elastic protrusion structure and includes an inverted V-shaped elastic member and an elastic protrusion provided at an open end of the inverted V-shaped elastic member, the elastic protrusion extends out of the first positioning hole and the second positioning hole and contacts a button, and the other end of the inverted V-shaped elastic member is arranged to abut a cavity wall of the accommodation cavity.

5. The button-type central locking device for the folding tent according to claim 3, wherein an end of the V-shaped spring in contact with the pin cap integrally extends to form a foot, and the foot and the V-shaped spring are arranged at an angle of 90 degrees.

6. The button-type central locking device for the folding tent according to claim 1, further comprising a button, wherein an upper side and an lower side of the button are correspondingly provided with bosses, the lower tray seat body and the lower tray seat cover are provided with grooves at positions corresponding to the bosses, and the bosses are respectively in cooperation use with the grooves.

7. The button-type central locking device for the folding tent according to claim 1, wherein four connection posts are evenly provided on an upper surface of the lower tray seat cover, four connection holes are provided at positions, of a lower surface of the lower tray seat body, corresponding to the connection posts, and the connection posts are respectively inserted in the connection holes and fastened with screws.

8. The button-type central locking device for the folding tent according to claim 1, wherein notches for mounting a button are respectively provided at corresponding positions of the lower tray seat body and the lower tray seat cover.

* * * * *